US007055806B2

(12) United States Patent
York, Jr. et al.

(10) Patent No.: US 7,055,806 B2
(45) Date of Patent: Jun. 6, 2006

(54) RAIL BARRICADE

(75) Inventors: John S. York, Jr., Midland, MI (US); Timothy J. Hockemeyer, Midland, MI (US)

(73) Assignee: Stageright Corporation, Clare, MI (US)

( * ) Notice: Subject to any disclaimer, the term of this patent is extended or adjusted under 35 U.S.C. 154(b) by 0 days.

(21) Appl. No.: 10/624,263

(22) Filed: Jul. 22, 2003

(65) Prior Publication Data

US 2004/0206945 A1 Oct. 21, 2004

Related U.S. Application Data

(60) Provisional application No. 60/397,700, filed on Jul. 22, 2002.

(51) Int. Cl.
*E04H 17/16* (2006.01)

(52) U.S. Cl. ..... 256/28; 256/21; 256/24; 256/25; 256/27; 256/29; 256/65.14; 403/109.6; 403/349; 403/378

(58) Field of Classification Search ..... 256/21, 256/22, 24, 25, 59, 65.01, 65.02, 65.1, 65.11, 256/65.15, 27–29, 65.14; 403/348–349, 403/109.1, 109.6, 324, 377, 378, 245, 263
See application file for complete search history.

(56) References Cited

U.S. PATENT DOCUMENTS 3,704,005 A * 11/1972 Kusel ..... 256/22
3,955,799 A * 5/1976 Lauzier ..... 256/21
4,240,764 A * 12/1980 Wegner
4,358,214 A * 11/1982 Shull ..... 403/263 X
4,646,807 A * 3/1987 Doublet ..... 256/24 X
4,647,016 A * 3/1987 Doublet ..... 256/24
5,186,197 A * 2/1993 Lavine ..... 403/349
5,354,037 A * 10/1994 Venegas, Jr. ..... 256/59
5,402,988 A * 4/1995 Eisele ..... 256/24
6,053,480 A * 4/2000 De Guise ..... 256/59
6,190,084 B1 * 2/2001 Ibanez
6,199,833 B1 * 3/2001 Bilby et al. ..... 256/24
6,676,113 B1 * 1/2004 Christensen et al. ..... 256/25

FOREIGN PATENT DOCUMENTS

FR 2503227 A1 * 10/1982
FR 2625238 A1 * 6/1989
GB 2063956 A * 6/1981

* cited by examiner

*Primary Examiner*—Daniel P. Stodola
*Assistant Examiner*—Michael P. Ferguson
(74) *Attorney, Agent, or Firm*—Carlson, Gaskey & Olds

(57) ABSTRACT

A rail barricade includes a bottom rail and a U-shaped body frame having a top rail and a pair of vertical rails. A plurality of vertical spokes are located between the vertical rails. The bottom rail further includes an opposing pair of curved ends each having a projection that is received in a notch in one of the vertical rails. The connection is then welded. A foot is pivotally attached to each of the vertical rails. Hooks are attached to one of the vertical rails for attachment of a second rail barricade.

28 Claims, 6 Drawing Sheets

RAIL BARRICADE

This application claims priority to provisional application Ser. No. 60/397,700 filed on Jul. 22, 2002.

BACKGROUND OF THE INVENTION

The present invention relates generally to a rail barricade including pivotable feet and a plurality of vertical spokes which is attachable to another rail barricade to create a barrier.

Rail barricades are often used in concerts and events to restrict a crowd to a certain area and to prevent the crowd from entering restricted areas. Prior art rail barricades are attached together by a rod and loop attachment to create a barrier of a desired length. Each rail barricade includes a plurality of loops on one side and a vertical rod on the opposing side. To attach the rail barricades, the vertical rod of one of the rail barricades is inserted into the plurality of loops on the other barricade. A plurality of rail barricades are attached in this manner to create a barrier of the desired length.

The frame of the prior art rail barricade is formed of a pair of vertical rails and a pair of horizontal rails which are welded together. A plurality of vertical spokes between the vertical rails are welded at opposing ends to the horizontal rails. The prior art rail barricade also includes a pair of feet perpendicular to the frame of the rail barricade.

A drawback to the rail barricade of the prior art is that each of the rail barricades must be lifted and angled relative to each other to assemble and disassemble the rail barricades, making connection and disconnection of the rail barricades difficult. Finally, as the feet of the prior art rail barricade are perpendicular to the frame, storage and transport of the rail barricade is difficult.

SUMMARY OF THE INVENTION

The rail barricade of the present invention includes a bottom rail and a U-shaped body frame having a top rail and a pair of vertical rails. A plurality of vertical spokes are located between the vertical rails.

The bottom rail includes a plurality of bottom holes and the top rail includes a plurality of top holes. In one example, each vertical spoke is inserted into one of the top holes and one of the bottom holes, and the connections of the vertical spokes, the top rail, and the bottom rail are welded. Alternately, the bottom rail includes a plurality of holes each having a curved surface and a flat portion and the top rail includes a plurality of circular top holes. Each vertical spoke includes a lower end with a flattened portion and an upper end with a circular cross-section. When assembled, the lower end of the vertical spoke is positioned in a bottom hole such that the flattened portion of the lower end engages the flat surface of the bottom hole, preventing rotation of the vertical spoke without welding.

The bottom rail further includes an opposing pair of curved ends each having a projection and a curvature equal to the curvature of the vertical rails. The projection of the bottom rail is received in a notch in the vertical rail. The connection is welded, securing the ends of the bottom rail to the vertical rail.

A first foot is pivotally attached to the bottom of one vertical rail, and a second foot is pivotally attached to the bottom of the other vertical rail. The second foot has a length and a height greater than the length and the height of the first foot. The feet are pivotal 90° between an in use position and a storage position. In the in use position, the feet are perpendicular to the bottom rail. In the storage position, the feet are parallel to the bottom rail.

Hooks are attached to one of the vertical rails to attach the rail barricade to a second rail barricade. The second rail barricade is angled approximately 30° from the rail barricade, and the vertical rail of the second rail barricade is positioned in the hooks of the rail barricade. The second rail barricade is then pivoted 30° to align with the rail barricade. When the rail barricades are to be detached, the second rail barricade is again pivoted 30° to allow detaching of the second rail barricade.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
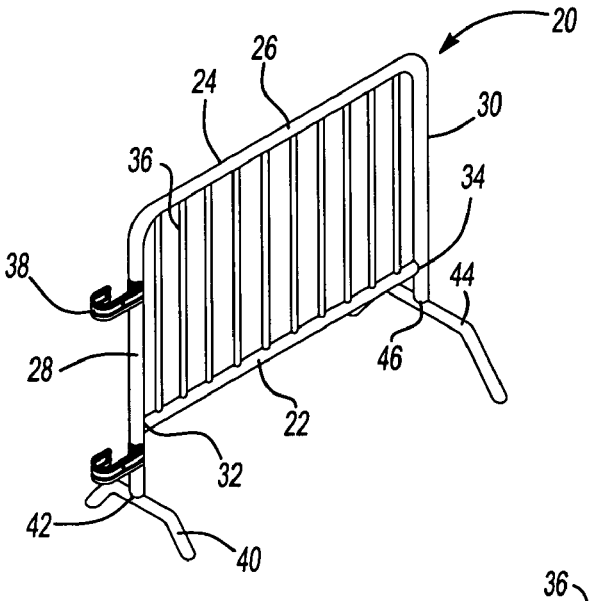
FIG. 1 illustrates a perspective view of the rail barricade of the present invention in the in use position.

FIG. 1 illustrates a rail barricade 20 including a bottom rail 22 and a U-shaped body frame 24 having a top rail 26 and a pair of vertical rails 28 and 30. The opposing ends 32 and 34 of the bottom rail 22 are each secured to the vertical rails 28 and 30. A plurality of vertical spokes 36 are located between the vertical rails 28 and 30. In one example, the plurality of vertical spokes 36 are attached to the vertical rails 28 and 30 by welding. However, other alternate attachments are possible as described below. Other rail constructions are possible other than the rail barricade 20 illustrated and described. Although ten vertical spokes 36 are illustrated in FIG. 1, it is to be understood that any number of vertical spokes 36 can be employed. Hooks 38 are attached to the vertical rail 28. However, hooks 38 can also be attached to the vertical rail 30. Preferably, two hooks 38 are employed, however, it is to be understood that any number of hooks 38 can be employed.

Figure 2:
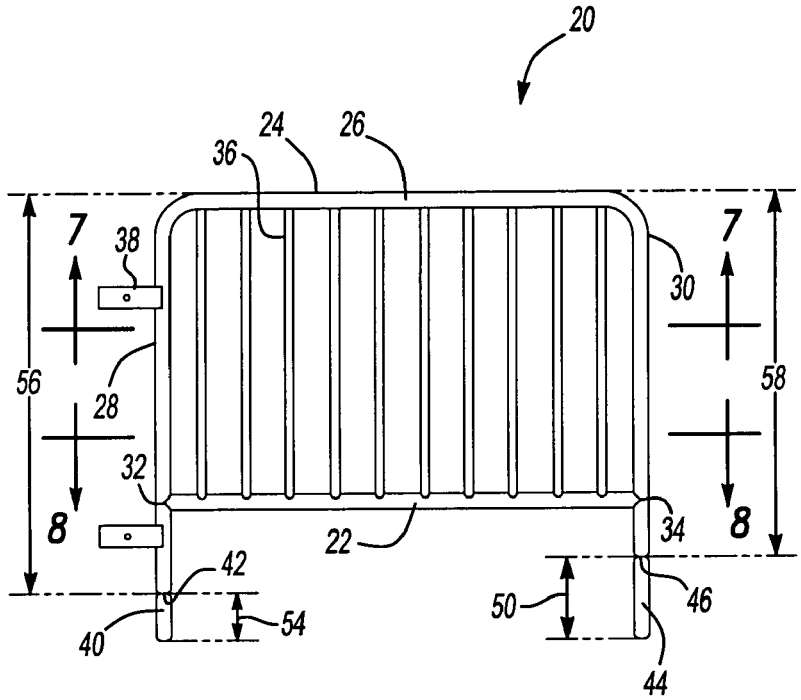
FIG. 2 illustrates a front view of the rail barricade.
Figure 3:
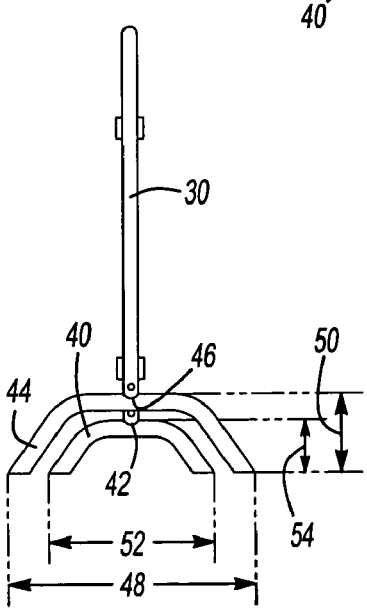
FIG. 3 illustrates a side view of the rail barricade.

As shown in FIGS. 2 and 3, a first foot 40 is pivotally attached to the bottom 42 of vertical rail 28, and a second foot 44 is pivotally attached to the bottom 46 of the vertical rail 30. The feet 40 and 44 can be angled, u-shaped, or flat and can include wheels. However, it is to be understood that other shapes of the feet 40 and 44 are possible. The second foot 44 has a length 48 and a height 50 that is greater than the length 52 and the height 54 of the first foot 40. As the second foot 44 has a height 50 greater than the height 54 of the first foot 40, the length 58 of the vertical rail 30 is shorter than the length 56 of the vertical rail 28. The height 50 of the second foot 44 plus the length 58 of the vertical rail 30 equals the height 54 of the first foot 40 plus the length 56 of the vertical rail 28.

Figure 4:
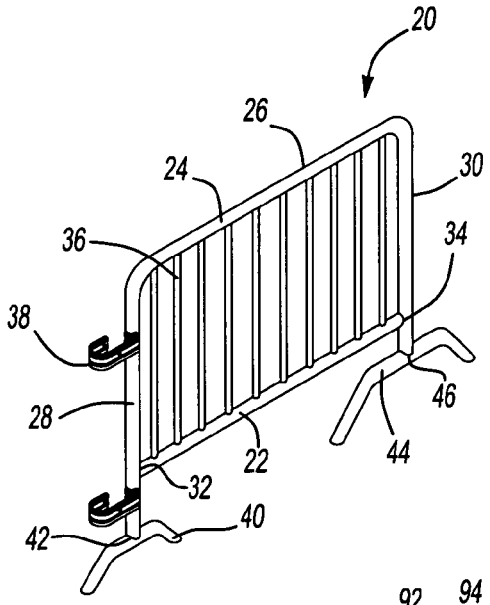
FIG. 4 illustrates a perspective view of the rail barricade in the stored position.

The feet 40 and 44 are pivotal 90° between an in use position shown in FIG. 1 and a storage position shown in FIG. 4. Although 90° has been disclosed, it is to be understood that other angles are possible. When the feet 40 and 44 are in the in use position, the feet 40 and 44 are perpendicular to the top rail 26 and the bottom rail 22. However, it is to be understood that other positions of the feet 40 and 44 are possible when the feet 40 and 44 are in the in use position. When the feet 40 and 44 are in the storage position, the feet 40 and 44 are parallel to the top rail 26 and the bottom rail 22. However, it is to be understood that other positions of the feet 40 and 44 are possible when the feet 40 and 44 are in the storage position. By pivoting the feet 40 and 44 to the storage position, transport of the rail barricade 20 is eased and more compact storage is possible. Additionally, it is to be understood that the pivotal feet 40 and 44 can be employed on other rail barricades other than the rail barricade 20 illustrated and described.

Figure 5:
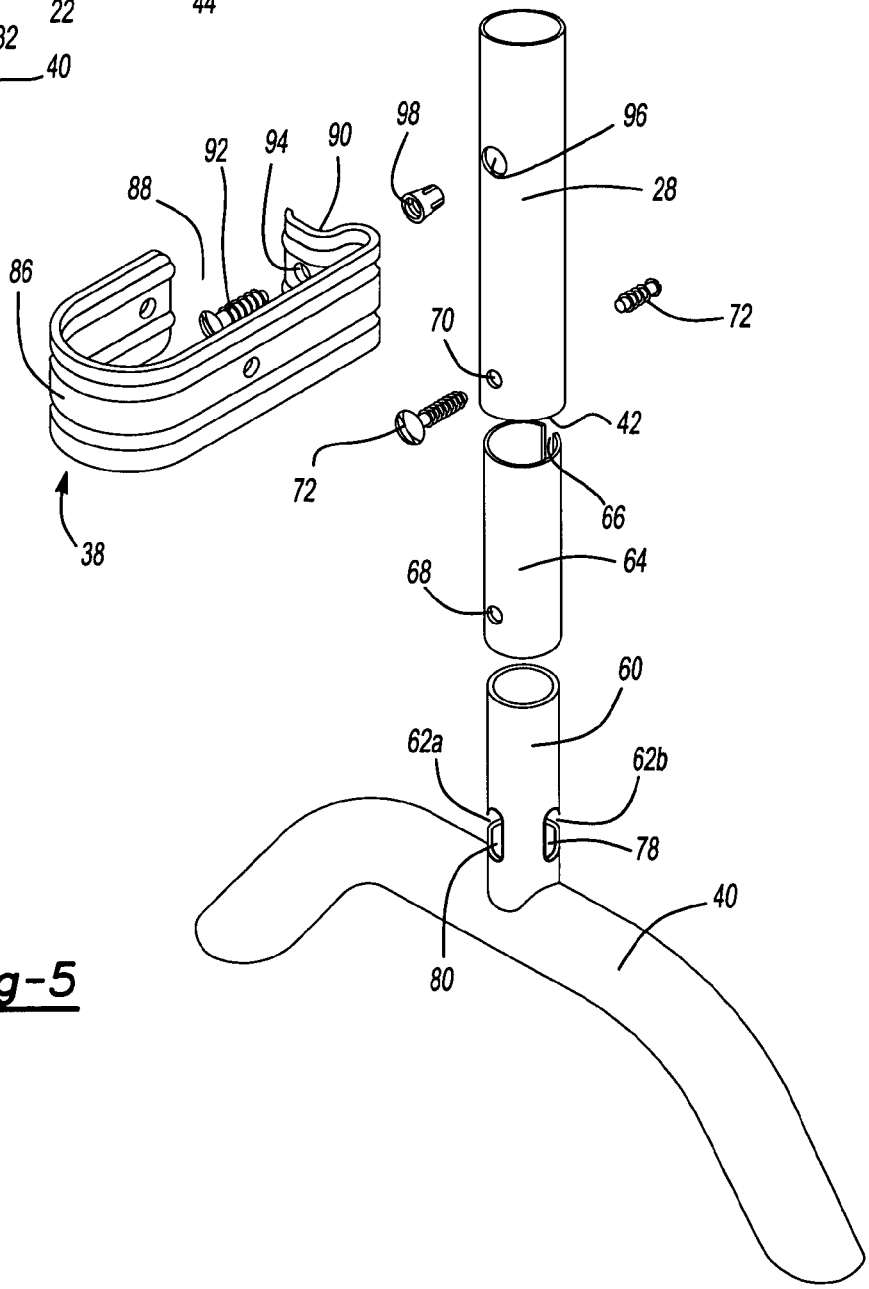
FIG. 5 illustrates a perspective exploded view of the first foot attached to a vertical rail.

FIG. 5 illustrates the attachment of the first foot 40 to the bottom 42 of the vertical rail 28. The first foot 40 includes a vertical portion 60 with a pair of opposing z-shaped cutouts 62*a* and 62*b*. A tube 64 including a vertical slit 66 and a hole 68 is positioned over the vertical portion 60. The vertical portion 60 and the tube 64 are inserted into the bottom 42 of the vertical rail 28. When assembled, the vertical rail 28 includes a pair of aligned holes 70 that align with the hole 68 and the z-shaped cutouts. An attachment member 72 is inserted in the aligned hole 68 and 70 and z-shaped cutouts 62*a* and 62*b*. Although z-shaped cutouts are disclosed and described, it is to be understood that other shapes are possible, such as L-slots, C-slots, 7-slots, or T-slots, or any other possible shapes. Additionally, the attachment member 72 can be a mate rivet, a bolt, or any other suitable attachment member. One skilled in the art would know what type of attachment members 72 to employ.

Figure 6:
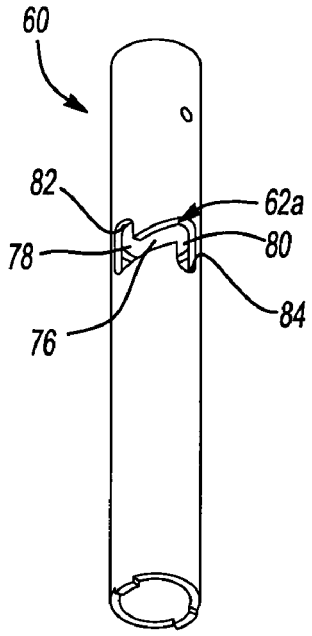
FIG. 6 illustrates a perspective view of the vertical portion of one of the feet.

FIG. 6 illustrates the z-shaped cutouts 62*a* which includes a main slot 76 and a pair of opposing vertical slots 78 and 80 each having an end 82 and 84, respectively. When the first foot 40 is in the in use position, the attachment member 72 is retained in the end 84 of the vertical slot 80. When the first foot 40 is manually pivoted 90° to the stored position, the attachment member 72 is removed from the end 84 and travels through the main slot 76 until entering the vertical slot 78 and the end 82, retaining the first foot 40 in the stored position. The z-shaped cutout 62*b* includes the same features as the z-shaped cutouts 62*a*.

Although only the first foot 40 has been illustrated and described, it is to be understood that second foot 44 includes the same features and is pivotally attached to the vertical rail 30 in the same manner. Additionally, it is to be understood that both the first foot 40 and the second foot 44 can be manually pivoted to other angles besides 90°. Finally, the feet 40 and 44 can be attached to the vertical rail 28 and 30, respectively, by a friction fit, a horizontal slot, without pins, or by other suitable types of attachment.

Returning to FIG. 5, each hook 38 includes a curved portion 86, an opening 88, and an attachment portion 90. A receiver 98 is inserted into a hole 96 in the vertical rail 28. The hooks 38 are attached to the vertical rail 28 by an attachment member 92 that passes through a hole 94 in the attachment portion 90 and the receiver 98 of the vertical rail 28. The attachment member 92 can be a bolt, rivet, or any other suitable types of attachment. The opening 88 of the hook 38 receives a vertical rail 30 of another rail barricade 20 when a plurality of rail barricades 20 are assembled, and the curved portion 86 retains the other rail barricade 20 once assembled.

Figure 7:
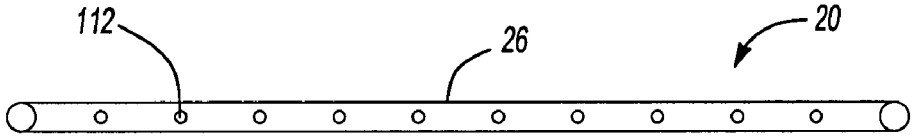
FIG. 7 illustrates a bottom view of the top rail along line 7—7 of FIG. 2.
Figure 8:
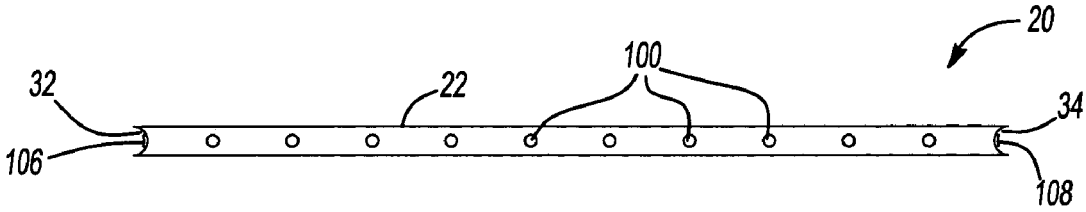
FIG. 8 illustrates a top view of the bottom rail along line 8—8 of FIG. 2.
Figure 9:
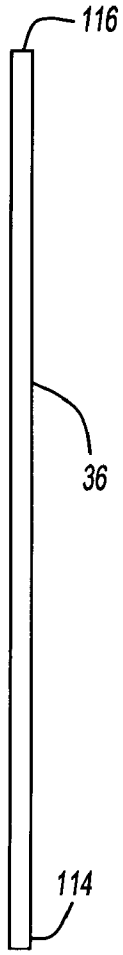
FIG. 9 illustrates a side view of a vertical spoke.

FIG. 7 illustrates a bottom view of the top rail 26 including a plurality of circular top holes 112, and FIG. 8 illustrates a top view of the bottom rail 22 including a plurality of circular top holes 100. The number of top holes 112 is equal to the number of bottom holes 100 and are positioned to align with the bottom holes 100 when the rail barricade 20 is assembled. As shown in FIG. 9, each vertical spoke 36 includes an upper end 116 and a bottom end 114.

The lower end 114 of each vertical spoke 36 is inserted into one of the bottom holes 100 of the bottom rail 22, and the upper end 116 of each vertical spoke 36 is inserted into one of the top holes 112 of the top rail 26. The connections of each vertical spoke 36 with both the top rail 26 and the bottom rail 22 are then welded to secure the vertical spoke 36 to the top rail 26 and the bottom rail 22.

Figure 10:
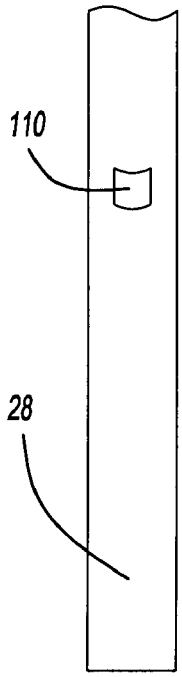
FIG. 10 illustrates a side view of one of the vertical rails.

The bottom rail 22 further includes a projection 106 at each end 32 and 34 of the bottom rail 22. The projection 106 or the bottom rail 22 is received in a hole 112 in the vertical rail 28, shown in FIG. 10. The connection is then welded, securing the curved end 32 of the bottom rail 22 to the vertical rail 28. The end 34 or the bottom rail 22 is attached to vertical rail 30 in the same manner.

Figure 11:
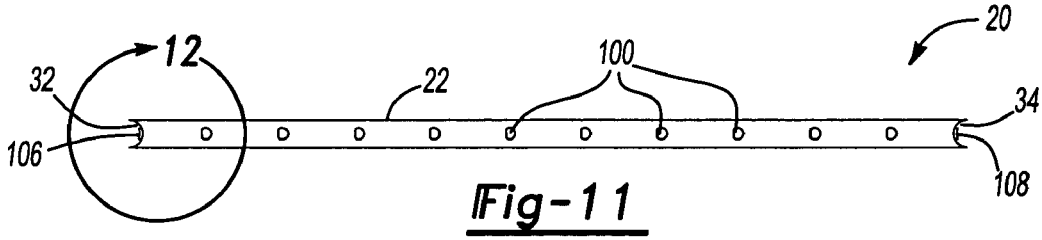
FIG. 11 illustrates a top view of an alternate embodiment of the bottom rail along line 8—8 of FIG. 2.
Figure 12:
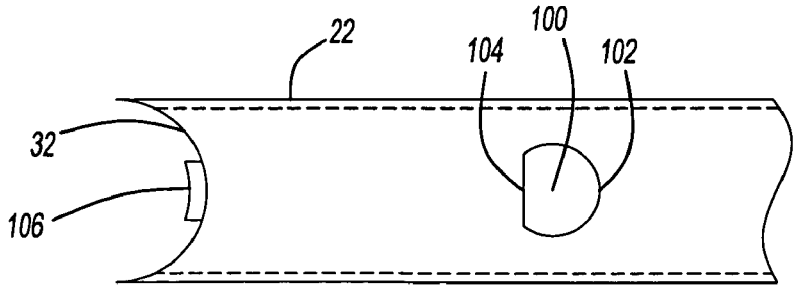
FIG. 12 illustrates an enlarged view of an end of the bottom rail of FIG. 11.

FIGS. 11 and 12 illustrate a top view of an alternate embodiment of the bottom rail 22 of the rail barricade 20. In this embodiment, the bottom rail 22 includes a plurality of bottom holes 100 each having a curved surface 102 and a flat surface 104. The number of bottom holes 100 is equal to the number of vertical spokes 36 in the rail barricade 20. As illustrated in FIG. 7, the top rail 26 include a plurality of circular top holes 112.

Figure 13:
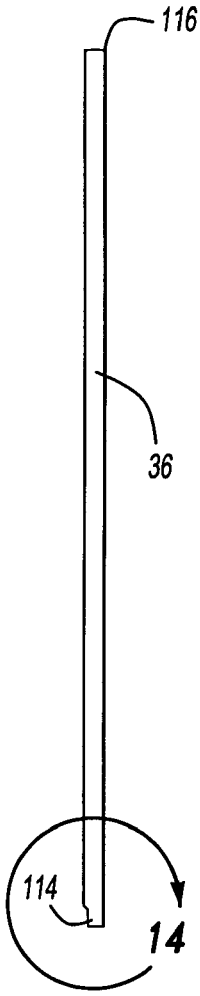
FIG. 13 illustrates a side view of a vertical spoke of an alternate embodiment.
Figure 14:
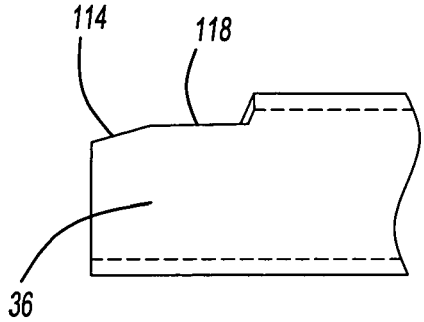
FIG. 14 illustrates an enlarged view of an end of the vertical spoke of FIG. 13.

FIGS. 13 and 14 illustrate a vertical spoke 36 of this embodiment including a lower end 114 having a flattened portion 118 and an upper end 116 having a circular cross-section. When the rail barricade 20 is assembled, the flattened portion 118 of the lower end 114 of the vertical spoke 36 engages the flat surface 104 of the bottom hole 100, preventing rotation of the vertical spoke 36. As the bottom rail 22 is welded to the vertical rails 28 and 30, the vertical spokes 36 are secured and do not need to be individually welded.

Although the lower end 114 of the vertical spoke 36 and the bottom hole 100 of the bottom rail 22 are illustrated as being flat, it is to be understood that other shapes which prevent rotation of the vertical spokes 36 are possible. Alternatively, the upper end 116 of the vertical spokes 36 and top holes 112 of the top rail 26 can include the flattened portion.

When assembling the rail barricade 20, the circular upper ends 116 of the vertical spokes 36 are inserted into the top holes 112 of the top rail 26. The bottom rail 22 is then assembled on the rail barricade 20 such that the flattened portion 118 of the vertical spokes 36 engage with the flat surface 104 of the bottom holes 100. The projections 106 and 108 of the ends 32 and 34, respectively, of the bottom rail 22 are then inserted into the corresponding notch 110 of the vertical rails 28 and 30, respectively, and the connection is welded. The holes 100 and 112 are formed in the bottom rail 22 and top rail 26, respectively, prior to the assembly of the rail barricade 20, and the plurality of vertical spokes 36 can be easily inserted into the holes 100 and 112 for assembly. The simple assembly of the rail barricade 20 does not require the assembly fixtures required by the prior art rail barricade.

Figure 15:
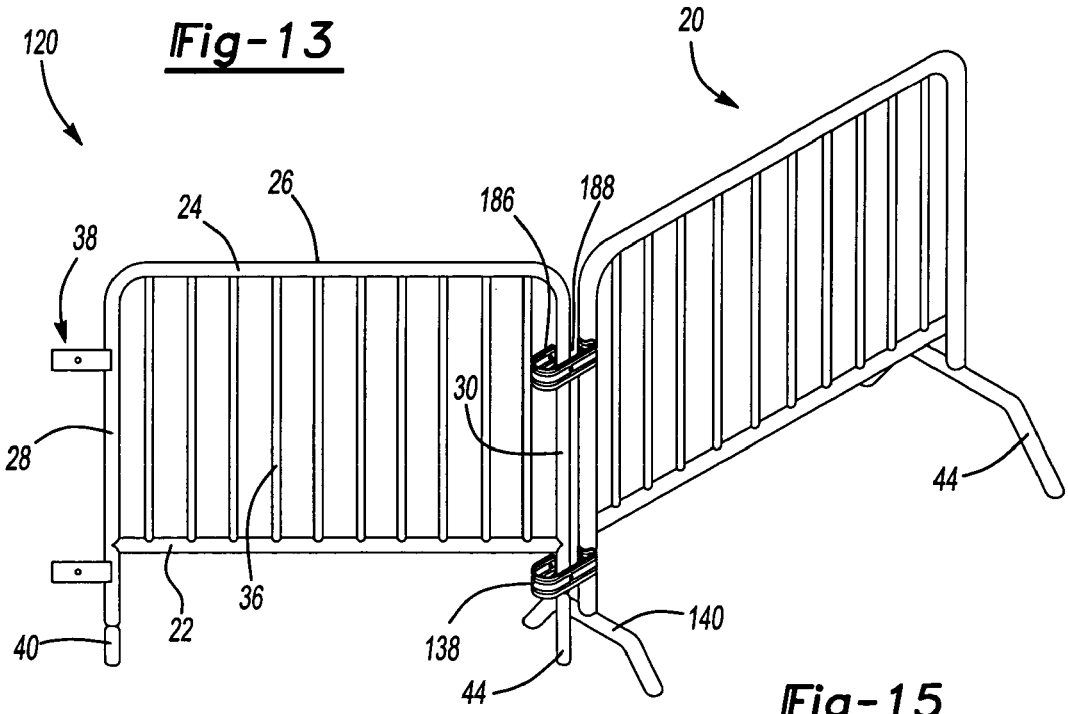
FIG. 15 illustrates a perspective view of a rail barricade pivoted relative to another rail barricade.

As shown in FIG. 15, when attaching the rail barricade 20 to a second rail barricade 120, the rail barricade 20 is angled approximately 30° relative to the rail barricade 120, and the vertical rail 30 of the rail barricade 20 is positioned in the opening 188 of the hooks 138 of the rail barricade 120. The first foot 140 of the rail barricade 120 is shorter than the second foot 44 of the rail barricade 20, and the feet 44 and 140 do not interfere with each other. Although 30° has been disclosed as the preferred angle between the rail barricade 20 and the rail barricade 120, it is to be understood that other angles are possible.

Figure 16:
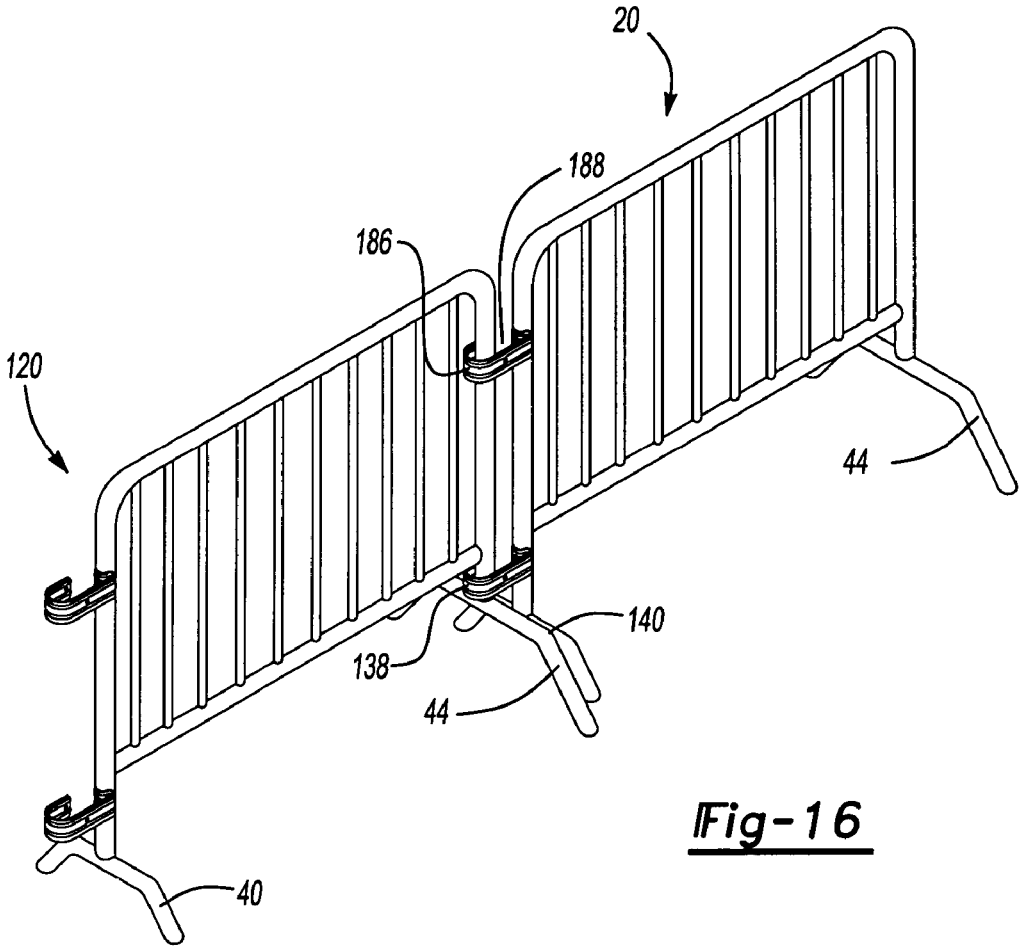
FIG. 16 illustrates a perspective view of a pair of attached rail barricades.

The rail barricade 20 is then pivoted to align with the rail barricade 120. When aligned, the second foot 44 of the rail barricade 20 is parallel to the first foot 140 of the rail barricade 120, as shown in FIG. 16. In the aligned position, the curved portion 186 of the hooks 138 attach the rail barricade 20 to the rail barricade 120. When aligned, the rail barricade 20 cannot be detached from rail barricade 120. The hooks 138 prevent the rail barricade 20 from detaching from the rail barricade 120.

When the rail barricades 20 and 120 are to be detached, the rail barricade 20 is pivoted 30°, returning the rail barricades 20 and 120 to the position of FIG. 15. As the first foot 140 of the rail barricade 120 is positioned under the second foot 44 of the rail barricade 20, the rail barricade 20 can be removed from the hooks 138.

Figure 17:
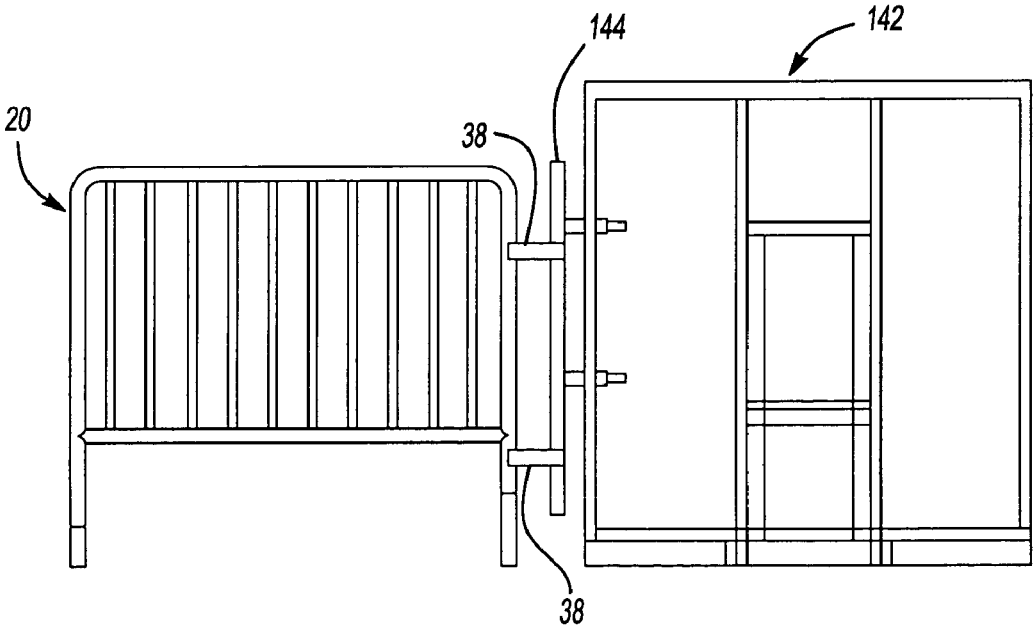
FIG. 17 illustrates the rail barricade of the present invention attached to a structure.

A plurality of rail barricades 20 are attached to form a barrier of a desired length. As shown in FIG. 17, the rail barricade 20 can also be attached to other structures 142 to create a barrier. The hooks 38 of the rail barricade 20 receive a rod 144 of the structure 142, securing the rail barricade 20 to the structure and forming a barrier. The structure 142 can be a wall, a seating riser, a bleacher, a building, a portable barricade, or any other type of structure.

When the rail barricade 20 is to be transported from one location to another, the feet 40 and 44 are pivoted to be generally parallel to the bottom rail 22. The rail barricade 20 can then be positioned on a transport and moved to a desired location for use or storage. During transport or storage, the rail barricades 20 can be easily stacked as the feet 40 and 44 are generally parallel to the bottom rail 22. Once the rail barricade is to be used, the feet 40 and 44 are pivoted to return to the in use position.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A rail barricade comprising:

a frame including a first vertical rail, a second vertical rail, and a top rail;

a bottom rail including a first end that is secured to said first vertical rail and a second end that is secured to said second vertical rail, said frame and said bottom rail defining a first side and a second side;

a plurality of vertical spokes each secured to said top rail and said bottom rail;

a first foot pivotally attached to said rail barricade;

a second foot pivotally attached to said rail barricade; and at least two hooks attached to said first vertical rail, each of said at least two hooks including an opening, and each opening is located said first side defined by said frame and said bottom rail and said at least two hooks are closed on said second side defined by said frame and said bottom rail.

2. The rail barricade as recited in claim 1 wherein said first foot is attached to said first vertical rail and said second foot is attached to said second vertical rail, and said first vertical rail has a first rail length and said second vertical rail has a second rail length, and said first rail length is greater than said second rail length, and said first foot has a first foot height and said second foot has a second foot height, and said second foot height is greater than said first foot height.

3. The rail barricade as recited in claim 1 wherein said first foot and said second foot are each pivotal approximately 90° between a use position and a storage position, and said first foot and said second foot are substantially perpendicular to said top rail and said bottom rail when said first foot and said second foot are in said use position and said First foot and said second foot are substantially parallel to said top rail and said bottom rail when said first foot and said second foot are in said storage position.

4. The rail barricade as recited in claim 1 wherein said first foot and said second foot each include a vertical stem having a pair of opposing cutouts, wherein said vertical stem of said first foot is inserted in to said first vertical rail and said vertical stem of said second foot is inserted into said second vertical rail.

5. The rail barricade as recited in claim 4 wherein said pair of opposing cutouts are each substantially z-shaped.

6. The rail barricade as recited in claim 4 further including an attachment member inserted into said pair of opposing cutouts of said vertical stem of each of said first foot and said second foot to secure said first foot to said first vertical rail and to secure said second foot to said second vertical rail.

7. The rail barricade as recited in claim 1 wherein said first end and said second end of said bottom rail each have an end curvature and said first vertical rail and said second vertical rail each have a rail curvature that is shaped to correspond to said end curvature.

8. The rail barricade as recited in claim 1 wherein said first end and said second end of said bottom rail each include a projection and said first vertical rail and said second vertical rail each include a notch, and said projection of said first end of said bottom rail is received in said notch of said first vertical rail and said projection of said second end of said bottom rail is received in said notch of said second vertical rail.

9. The rail barricade as recited in claim 8 wherein said bottom rail is secured to said first vertical rail and said second vertical rail by a weld bead.

10. The rail barricade as recited in claim 1 wherein each of said plurality of vertical spokes are attached to said top rail and said bottom rail by a weld bead.

11. The rail barricade as recited in claim 1 further including a second rail barricade, and said at least two hooks secure said second rail barricade to said rail barricade.

12. The rail barricade as recited in claim 11 wherein said second rail barricade is pivoted approximately 30° relative to said rail barricade to attach said second rail barricade to said rail barricade and to remove said second rail barricade from said rail barricade.

13. The rail barricade as recited in claim 12 wherein said second rail barricade includes a vertical rail having a longitudinal axis, and said second rail barricade is pivoted about said longitudinal axis of said vertical rail of said second rail barricade.

14. The rail barricade as recited in claim 1 wherein said frame is integrated into a single piece.

15. The rail barricade as recited in claim 1 wherein a second rail barricade is receivable in said opening of each of said at least two hooks.

16. The rail barricade as recited in claim 15 wherein said second rail barricade is pivoted about a longitudinal axis of a vertical rail of said second rail barricade to attach said second rail barricade to said rail barricade, said vertical rail of said second rail barricade is inserted into said opening of each of said at least two hooks of said rail barricade, and said second rail barricade is pivoted in a reverse direction to secure said second rail barricade to said rail barricade.

17. The rail barricade as recited in claim 16 wherein said second rail barricade is pivoted approximately 30° relative to said rail barricade.

18. The rail barricade as recited in claim 1 wherein each of said plurality of vertical spokes has a substantially circular cross-section.

19. The rail barricade as recited in claim 18 wherein each of said plurality of vertical spokes includes an end having a flat portion.

20. The rail barricade as recited in claim 1 wherein said first foot and said second foot are each substantially u-shaped.

21. The rail barricade as recited in claim 1 wherein said first vertical rail includes a first bottom and said second vertical rail includes a second bottom, and said first foot is attached to said first bottom of said first vertical rail and said second foot is attached to said second bottom of said second vertical rail.

22. A rail barricade comprising:

a frame including a first vertical rail, a second vertical rail, and a top rail:

a bottom rail including a first end that is secured to said first vertical rail and a second end that is secured to said second vertical rail, said frame and said bottom rail defining a plane;

a plurality of vertical spokes each secured to said ton rail and said bottom rail;

a first foot pivotally attached to said rail barricade;

a second foot pivotally attached to said rail barricade, wherein said first foot and said second foot include a vertical stein having a flair of opposing cutouts that are each substantially Z-shaped, and said vertical stem of said first foot is inserted into said first vertical rail and said vertical stem of said second foot is inserted into said second vertical rail, further including tubes each having a vertical slit and a hole, one of said tubes is positioned between said vertical stem of said first foot and said first vertical rail and another of said tubes is positioned between said vertical stem of said second foot and said second vertical rail; and at least two hooks attached to said first vertical rail, each of said at least two hooks including an opening, and each opening is located on a common side of said plane defined by said rail barricade.

23. A method of forming a rail barricade comprising the steps of:

pivotally attaching a first foot to a frame; pivotally attaching a second foot to said frame;

inserting a top end of each of a plurality of vertical spokes into one of a plurality of top holes of a top rail of said frame;

inserting a bottom end of each of said plurality of vertical spokes into one of a plurality of bottom holes of a bottom rail of said frame, the frame and the bottom rail defining a first side and a second side;

securing a first end and a second end of said bottom rail to a first vertical rail and a second vertical rail, respectively; and securing at least two hooks to said first vertical rail of said frame, each of said at least two hooks including an opening, and each opening is located on said first side defined by the rail barricade and said at least two hooks are closed on said second side defined by said frame and said bottom rail.

24. The method as recited in claim 23 wherein said first foot and said second foot are pivotal approximately 90° between a use position and a storage position.

25. The method as recited in claim 23 wherein the step of securing includes welding.

26. The method as recited in claim 23 further including the steps of preventing rotation of each of said plurality of vertical spokes relative to said top rail and said bottom rail, and each of said plurality of vertical spokes have a substantially circular cross-section and an end with a flat portion that engages a flat surface in one of the plurality of top holes and the plurality of bottom holes.

27. The method as recited in claim 23 further including the step of attaching a second rail barricade to said rail barricade and the step of attaching includes pivoting the second rail barricade in a first direction about a longitudinal axis of a vertical rail of said second rail barricade, inserting the vertical rail of said second rail barricade in said opening of each of said at least two hooks and pivoting said second rail barricade in an opposing direction about the longitudinal axis.

28. The method as recited in claim 27 where said second rail barricade is pivoted approximately 30°.

* * * * *